United States Patent [19]

Hirakura et al.

[11] 4,369,733

[45] Jan. 25, 1983

[54] TONER CONCENTRATION CONTROL APPARATUS

[75] Inventors: Koji Hirakura, Yokohama; Yasuo Sawada, Sayama; Kenta Watase, Tokyo; Takahiko Kitamura, Yokohama, all of Japan

[73] Assignee: Ricoh Company, Ltd., Tokyo, Japan

[21] Appl. No.: 203,808

[22] Filed: Nov. 3, 1980

[30] Foreign Application Priority Data

Nov. 7, 1979 [JP] Japan ..... 54-143960

[51] Int. Cl.[3] ..... G03G 15/09; G03G 21/00

[52] U.S. Cl. ..... 118/691; 118/688

[58] Field of Search ..... 118/689, 690, 691, 688; 222/57, DIG. 1

[56] References Cited

U.S. PATENT DOCUMENTS 3,756,192 9/1973 Locklar et al. ..... 118/691

4,292,925 10/1981 Terashima ..... 118/690

*Primary Examiner*—Evan K. Lawrence

*Attorney, Agent, or Firm*—Oblon, Fisher, Spivak, McClelland & Maier

[57] ABSTRACT

A toner concentration control apparatus of the type for allowing developer to pass through a chute, which is capable of detecting stopping of the flow of the developer in the chute, clogging of the chute with the developer, or coating of a viewing window formed in the chute with the developer, and upon occurrence of such abnormalities, minimizing the trouble therefrom in the operation of the copying machine, in which light from a single light source is simultaneously detected by two photosensors, the light striking one of the photosensors directly and the other after being reflected from the developer comprising toner and carrier particles as the developer passes a viewing window in the chute provided for the detection of the toner concentration within the copying machine, and the output of the photosensors is compared with each other and the concentration of toner in the developer can be determined and adjusted by the comparison value. In addition, the output of the photosensor which receives the light reflected from the developer contains an A.C. component signal which indicates the flow of the developer along the inside of the viewing window, and a D.C. component signal which corresponds to the concentration of toner in the developer, and, by detecting the presence or absence of the A.C. component signal, abnormalities in the flow of developer are detected.

9 Claims, 4 Drawing Figures

TONER CONCENTRATION CONTROL APPARATUS

BACKGROUND OF THE INVENTION

The present invention relates to a toner concentration control apparatus for an electrophotographic copying machine, electrostatic recording apparatus or the like, for controlling the concentration of toner in the supply of a two-component type developer comprising at least toner and carrier, by detecting the toner concentration of the developer, and more particularly to a toner concentration control apparatus of the type described capable of detecting abnormalities in the operation of the toner concentration control apparatus, such as stopping of the flow of the developer or clogging of the same in the toner concentration control apparatus.

In order to produce satisfactory copies by an electrophotographic copying machine employing the two-component type developer, it is necessary that the proper ratio of toner to carrier be maintained. However, each time a copy is made, some toner is used for imaging and thus depleted from the supply, and the images produced on subsequent copies will be fainter (at first not noticeably so, but increasingly as more copies are made) unless quantities of toner are added to the developer to replace that which has been used.

In order to eliminate this shortcoming, the development apparatuses of conventional electrophotographic copying machines can be provided with toner concentration control means which operate toner replenishing devices for adding toner to the developer when necessary. Generally, a toner concentration control means comprises a toner mixing-ratio detection means for detecting the ratio of toner to carrier in the developer, and a toner replenishment decision means, which compares the output signal from the toner mixing-ratio detection means with a reference signal indicating, for example, the desired concentration, and which actuates the toner replenishing device in accordance with the decision of the decision means.

An example of such toner concentration control apparatus is disclosed in Japanese Patent Publication No. 38-17245. In the toner concentration control apparatus disclosed, light from a light source is projected onto the developer held in the reservoir, and the light reflected from the developer is detected by a photosensor element. Thereafter, in accordance with the intensity of the reflected light, toner is replenished. This toner concentration control apparatus has proved to be entirely unsatisfactory, since, if the intensity of light from the light source varies due to some variation in the power or for other reasons, the output of the light-receiving photosensor element will be affected. Further, if the photosensor element changes in characteristics, for example, due to age or change in the ambient temperature, its output may also vary. Therefore, the change in the concentration of toner in the developer cannot be detected accurately by the toner concentration control apparatus disclosed in Japanese Patent Publication No. 38-17245.

Furthermore, in this type of toner concentration control apparatus, smearing of the photosensor element with the developer, which is apt to be scattered out of the developer reservoir, is a serious problem causing inaccurate measurement of the toner concentration. Nothing is mentioned as a countermeasure for eliminating such drawbacks and no apparatus is provided for detecting abnormalities in the operation of the toner concentration control apparatus in Japanese Patent Publication No. 38-17245.

Another example of a toner concentration control apparatus, which is an improvement on the above-mentioned Japanese Patent Publication No. 38-17245 to some extent, is disclosed in United States Patent Publication No. 3,756,192. In this apparatus, a chopper wheel, which serves as a calibrated reflector, having a value of reflectance on its blades equal to that of developer of the desired toner concentration, is rotated in front of a single light source. Light is thus alternately reflected from the developer containing toner and from the calibrated reflector, to a photosensor. When an imbalance of toner in the developer results in a difference in reflected light intensity between the developer and reflector, the difference is converted into an electrical signal having an A.C. component. A phase-sensing circuit detects the position of the peak of the A.C. signal component with reference to the position of the calibrated reflector and provides a control signal to a toner replenishing device. This toner concentration control apparatus has an advantage over the aforementioned prior-art toner concentration control apparatus in that utilization of a single light source and a calibrated reflector for reference compensates for variations in output of the light source. However, this toner concentration control apparatus requires a device for rotating the chopper wheel, i.e., the calibrated reflector, which makes the toner concentration control apparatus complex in mechanism, over-sized and expensive. Furthermore, since it contains movable portions, those movable portions may be abraded while in use over an extended period of time, with the result that the reliability of the apparatus may be lowered.

Furthermore, in this toner concentration control apparatus disclosed in United States Patent Publication No. 3,756,192, the calibrated reflector and the photosensor are susceptible to smearing by the airborne toner particles, since they are not protected from the toner particles and an apparatus for detecting the abnormality of the toner concentration control apparatus is not provided.

A further toner concentration control apparatus of the type which senses toner concentration by sensing variations in reflectivity of the developer is disclosed in United States Patent Publication No. 3,830,401. In this toner concentration control apparatus, pulses of radiation (i.e., light), periodically produced by a radiation source at a selected frequency, are directed to the developer mixture, and the reflectance thereof is monitored by a photoelectric transducer which produces a first output signal representative of the intensity of such reflectance. A second photoelectric transducer illuminated directly through the airborne toner cloud in the apparatus by the radiation source produces a second output signal representative of the intensity of the radiation emanating from the source as modulated by the surrounding environment. The toner concentration is detected by comparing the first output with the second output and, in accordance with the result of the comparison, toner is replenished to the developer when necessary, whereby the concentration of toner in the developer is controlled. In this apparatus, variations in output of the radiation source can be compensated for, since the radiation source is shared by the two photoelectric transducers. However, this apparatus requires a pulse generator for energizing the radiation source to produce pulses of radiation at a selected frequency, which is very expensive.

Furthermore, in this toner concentration control apparatus, the radiation source and the two photoelectric transducers are faced with the airborne toner particles circulating within the apparatus. Therefore, it has the short-coming that uncompensated for error will be caused with respect to the radiation source and the two photoelectric transducers if they are smeared differently with the airborne toner particles. Further, an apparatus for detecting the abnormalities in the operation of the toner concentration control apparatus is not provided.

In order to eliminate the above-mentioned short-comings of the prior-art apparatuses, toner concentration control apparatus is proposed, in which light from a single light source is simultaneously detected by two photosensors, the light striking one of the photoconductors directly (or indirectly from a reference reflection and transmission means) and the other after being reflected from developer comprising toner and carrier particles as the developer passes a viewing window in a chute provided for the transport thereof within the development apparatus of a copying machine. By comparing the two outputs of the two photosensors, toner is replenished to the developer supply. The light source and the two photosensors are supported by a rigid support means fixed to the chute and which forms a multichannel light path for the light source therein, and the light path, the light source, the photosensors and the external surface of the viewing window are all sealed from the surrounding environment by the support means. Furthemore, because the two photosensors are substantially identical in characteristics including response to ambient conditions and deterioration thereof with time, the accuracy of the toner concentration determination can be maintained with long-term stability.

In the toner concentration control apparatus of the above-mentioned type, some foreign materials are apt to enter the chute, coagulating the developer, and the chute will be easily clogged with the coagulated developer, causing inaccurate reading of the toner concentration. More specifically, if the chute is clogged with the developer when the toner concentration decreases and replenishment of toner is required, the toner concentration will continuously add toner to the developer supply beyond the desired level, based on the reading of the low toner concentration. On the other hand, if the chute is clogged with the developer when the toner concentration is sufficiently high, no toner will be replenished thereafter even if the toner concentration decreases, and the images produced on subsequent copies will be fainter, although the toner concentration control apparatus indicates that the toner concentration is sufficiently highly.

In order to prevent such improper replenishment of toner, in U.S. Patent Publication No. 4,032,227, there is disclosed a toner concentration control apparatus in which toner is added to the developer supply at predetermined intervals and the frequency of the addition of toner is checked, whereby it is prevented to add excess toner to the developer supply. However, this toner concentration control apparatus requires a counter circuit and other devices for performing the periodical addition of toner to the developer supply and checking the frequency thereof, which makes the apparatus expensive. Further, it has a shortcoming that even if the number of times of replenishing toner to the developer supply is preset, particularly for judging the abnormality of the operation of the apparatus, that preset number may vary, depending upon how often the copying machine is used, and therefore it is not always convenient for practical use.

Furthermore, if the above-mentioned toner concentration control apparatus is applied to a toner concentration control apparatus of the type using a chute for allowing the developer to pass therethrough, and the chute is clogged with the developer or for some other reason, the control apparatus cannot detect such abnormalities immediately and accordingly the copying machine cannot be stopped immediately.

SUMMARY OF THE INVENTION

It is therefore an object of the present invention to provide a toner concentration control apparatus of the type for allowing developer to pass through a chute, which is capable of detecting stopping of the flow of the developer in the chute, clogging of the chute with the developer, or coating of a viewing window formed in the chute with the developer, and upon occurrence of such abnormalities, minimizing the trouble therefrom in the operation of the copying machine.

According to the present invention, light from a single light source is simultaneously detected by two photosensors, the light striking one of the photosensors directly and the other after being reflected from the developer comprising toner and carrier particles as the developer passes the viewing window provided for the detection of the toner concentration within the copying machine. The output of the photosensors in the developer can be determined and adjusted by the comparison value. In addition, it has been observed that the output of the photosensor which receives the light reflected from the developer contains an A.C. component signal which indicates the flow of the developer along the inside of the viewing window, and a D.C. component signal which corresponds to the concentration of toner in the developer. In the present invention, by detecting the presence or absence of the A.C. component signal, abnormalities in the operation of the toner concentration control apparatus are detected and in accordance with the immediate indication of the abnormalities, accurate reading of the toner concentration and the proper operation of the toner concentration control apparatus are guaranteed.

DETAILED DESCRIPTION OF THE PREFERRED EMBODIMENT

Figure 1:
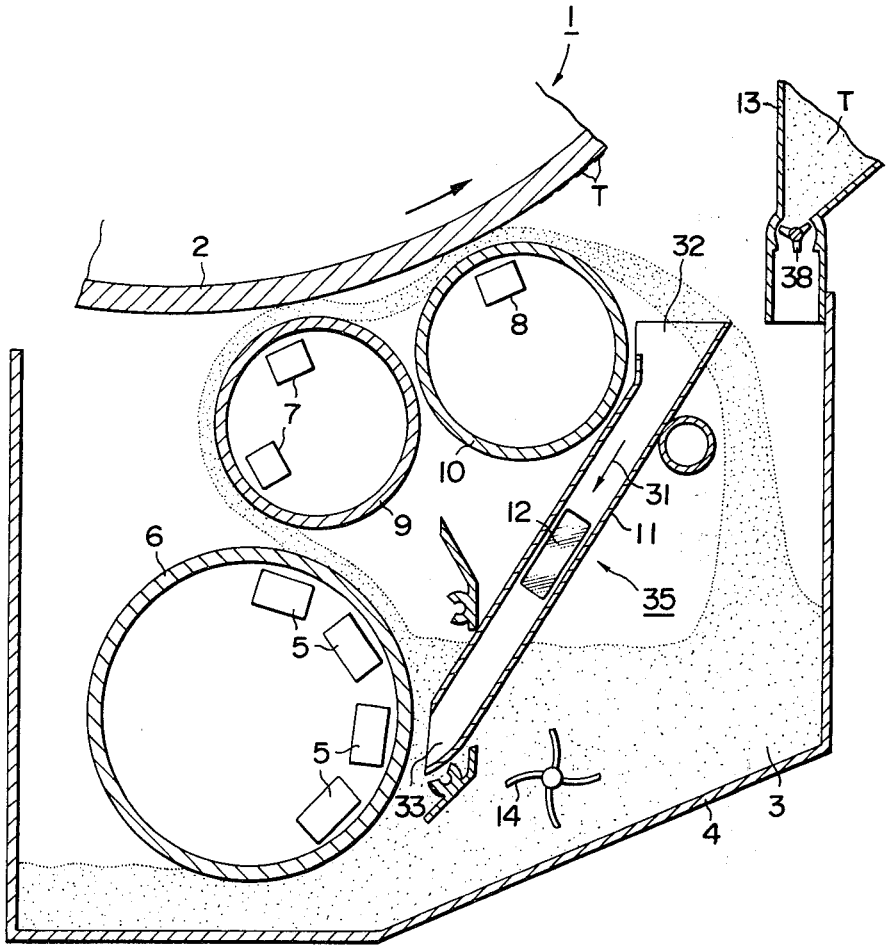
FIG. 1 shows schematically a development apparatus of a conventional electrophotographic copying machine in which an embodiment of a toner concentration control apparatus according to the present invention is employed.

Referring to FIG. 1, there is shown a development apparatus 1 of a conventional electrophotographic copying machine to which the present invention can be applied. The development apparatus 1 applies a two-component type developer 3 comprising toner and carrier to a photoconductor drum 2 which bears a latent electrostatic image on the surface thereof, corresponding to an optical image of an original document (not shown). The toner and carrier have been uniformly mixed with each other during the flow within the development apparatus 1 or while stirred by a stirrer 14 within a developer reservoir 4, so that the toner has been triboelectrically charged to a polarity opposite to that of the latent electrostatic image and is attracted to the latent electrostatic image by the electrostatic forces thereof, developing the latent electrostatic image, as the photoconductor drum 2 is rotated in the direction of the arrow in FIG. 1.

More specifically, the developer 3 is scooped up onto the surface of a conventional developer-transfer roller 6 with inner magnets 5, as the developer-transfer roller 6 is rotated. The developer 3 is then delivered onto a first development roller 9 with inner magnets 7 and then to a second development roller 10 with inner magnets 8. The first and second development rollers 9 and 10 are disposed in close proximity to the surface of the photoconductor drum 2, so that the developer 3 is supplied to the latent electrostatic image formed on the surface of the photoconductor drum 2 by the two development rollers 9 and 10.

The developer 3 which has not been used in the development returns to the developer reservoir 4. In the course of the return of the developer 3 from the second development roller 10 to the developer reservoir 4, part of the developer 3 enters a chute member 11 disposed near the second development roller 10, following a flow path 31 formed in the chute member 11, and then returns to the developer reservoir 4 through the chute member 11, where the developer 3 is again stirred by the stirrer 14 and uniformly mixed with toner replenished thereto from a toner replenishment apparatus 13. The timing of the actuation of the toner replenishment apparatus 13 will be described later.

Thus, the uniformly mixed developer 3 is again transported onto the photoconductor drum 2 by the rollers 6, 9 and 10 in the same manner as mentioned above for development of the latent electrostatic image on the photoconductor drum 2.

As shown in FIG. 1, the chute member 11 includes an upper inlet pocket 32 located near the second development roller 10, which is wider at the top than at the bottom thereof and collects a funnel-shaped quantity of the developer 3 therein, and an outlet portion 33 which is small enough to cause packed flow of the developer 3 through the chute member 11. In the central portion of the chute member 11, there is mounted a viewing window 12 made of "NESA" glass which is transparent and electrically grounded in order to prevent electrostatic clinging of the developer 3 to the viewing window 12. Furthermore, the chute member 11 is inclined, so that the developer 3 is caused to flow through the flow path 31 in heavy contact with the inner surface of the chute member 11, including the inner surface 34 of the viewing window 12.

Figure 2:
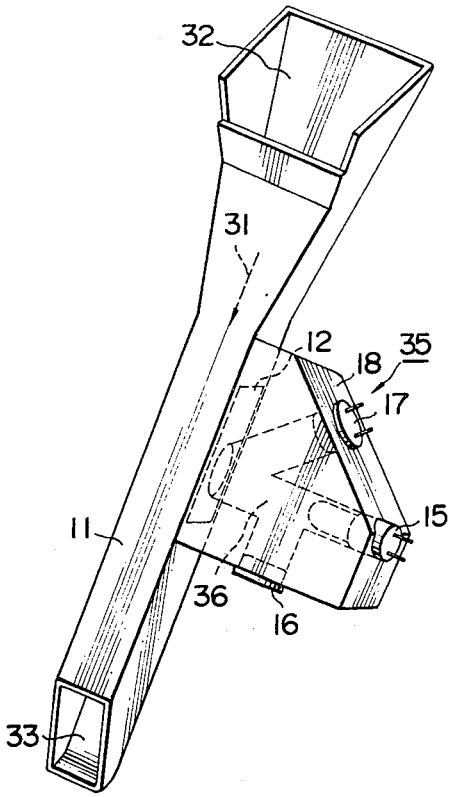
FIG. 2 is a perspective view of a toner concentration detection apparatus of the toner concentration control apparatus in FIG. 1.
Figure 3:
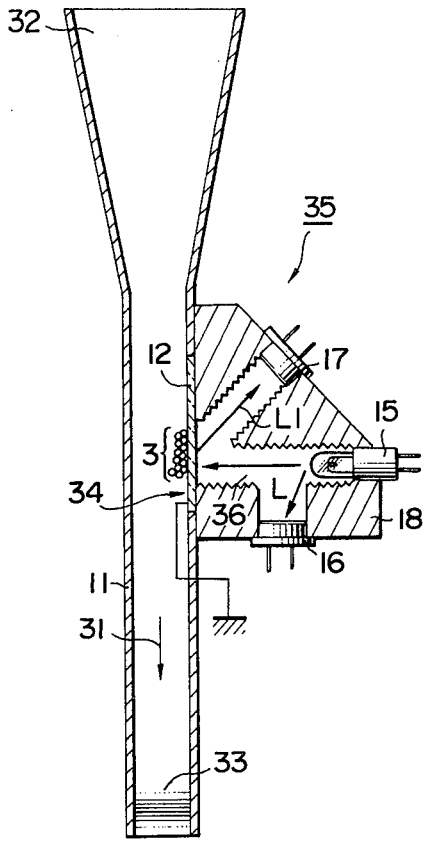
FIG. 3 is a cross section of the toner concentration detection apparatus in FIG. 2.

Referring to FIG. 2 and FIG. 3, a block-formed support member 18 is attached integrally to the chute member 11 at the portion in which the viewing window 12 is mounted. The support member 18 is made of a rigid material, for instance, a rigid piece of resinous material, and is formed with a hole 36 which pierces the same. The hole 36 constitutes a multi-channel light path comprising three connected channels. One of the channels extends from the viewing window 12 to a light source 15 disposed in the opposite end of the channel with respect to the viewing window 12. The second of the channels intersects the first channel at a predetermined position between the viewing window 12 and the light source 15 and extends therefrom in the lower direction of the support member 18 and in the opposite end of which a first photosensor element 16 is disposed. The third of the channels intersects the first channel at the viewing window 12 and extends therefrom at an acute angle with respect to the first channel, and at the end of which a second photosensor element 17 is disposed.

The first photosensor element 16 directly receives illumination light L from the light source 15, which serves as reference light, while the second photosensor element 17 receives reflected light L1 from the developer 3 via the viewing window 12. Thus, the light source 15, the first photosensor element 16 and the second photosensor element 17 which are arranged in the channels of the support member 18 constitute a toner concentration detection apparatus 35 as shown in FIGS. 2 and 3.

The inside of the channels is treated so as not to reflect light therefrom, so that unnecessary light does not enter the photosensor elements 16 and 17. Furthermore, the channels are sealed completely by the viewing window 12, the two photosensor elements 16 and 17 and the light source 15, so that airborne developer is not carried into the respective channels and does not accumulate on the external surfaces of the light source 15, the photosensor elements 16 and 17 or the viewing window 12, assuring the long-term stability of the toner concentration detection apparatus 35. The first and second photosensor elements 16 and 17 and the light source 15 can be fixed and sealed by use of an adhesive.

Figure 4:
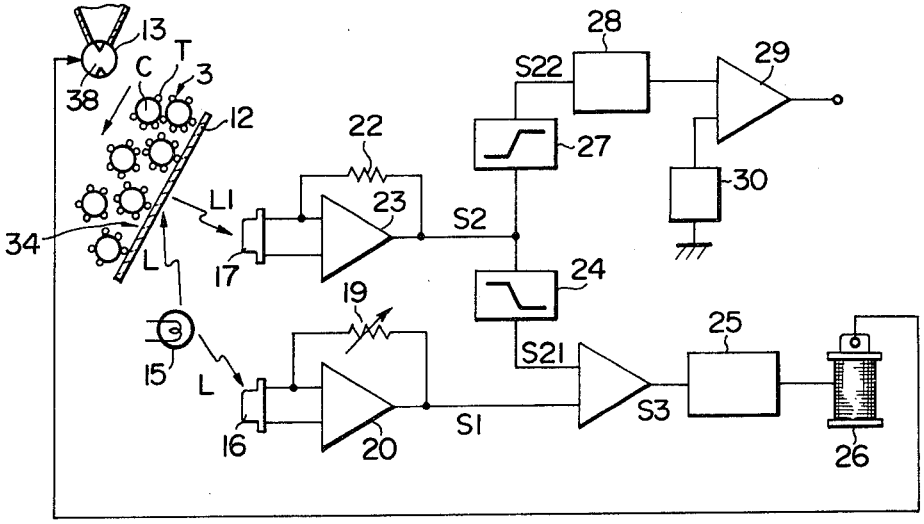
FIG. 4 is a circuit diagram of an embodiment of a toner concentration control apparatus according to the present invention.

Referring to FIG. 4, there is shown a block diagram of an embodiment of a toner concentration control apparatus according to the present invention, in which the aforementioned toner concentration detection apparatus 35 is employed. As mentioned previously, the illumination light L from the light source 15 is received directly by the first photosensor element 16, and, at the same time, the illumination light L passes through the viewing window 12 and impinges on the developer 3 consisting of toner particles T and carrier particles C, located adjacent to the inner surface 34 of the viewing window 12. Of the illumination light L, the portion which impinges on toner particles T is relatively more absorbed by the toner particles T, while the portion which impinges on carrier particles C is absorbed far less. Stated differently, the carrier particles C reflect more light than the toner particles T do. Therefore, the lower the concentration of the toner, the higher the reflectivity of the developer 3. Thus, the intensity of the reflected light L1 varies, depending upon the proportion of the toner and the carrier in the developer 3.

The first photosensor element 16 directly receives illumination light L from the light source 15 and produces a D.C. reference current in accordance with the intensity of the light from the light source 15. The reference current is amplified to a reference voltage signal S1 by a first amplifier circuit comprising a variable resistor 19 and an amplifier 20. The reference voltage signal S1 is then input to a comparator 21.

On the other hand, the reflected light L1 is received by the second photosensor element 17 and is then converted to a detection current, which is amplified to a detection voltage signal S2 by a second amplifier circuit comprising a resistor 22 and an amplifier 23. The detection voltage signal S2 includes D.C. components corresponding to the toner concentration of the developer 3 and A.C. components which are produced by the flow of the developer along the inner surface 34 of the viewing window 12, irrelevant to the variation in toner concentration of the developer 3. Therefore, the detection voltage signal S2 is input to a low-pass filter 24 in order to eliminate the A.C. components from the detection voltage signal S2, and is converted to a toner concentration voltage signal S21 which corresponds in value to the toner concentration of the developer 3.

The toner concentration voltage signal S21 is input to the comparator 21, where the reference voltage signal S1 and the toner concentration voltage signal S21 are compared with each other. When the difference between the reference voltage signal S1 and the toner concentration voltage signal S21 or their comparison value is below a predetermined level, an activation signal S3 for activating a driver 25 which energizes a solenoid 26 to open a valve 38 of the toner replenishment apparatus 13 is not produced. However, when the comparison value exceeds the predetermined level as a result of the decrease of the toner concentration below the desired level, the comparator 21 outputs the activation signal S3 to the driver 25, so that the solenoid 26 is energized and the valve 38 of the toner replenishment apparatus 13 is opened by the solenoid 26. As a result, toner is added from the toner replenishment apparatus 13 to the developer supply. When the toner concentration reaches the desired level and the difference between the reference voltage signal S1 and the toner concentration voltage signal S21 decreases below the predetermined level, the activation signal S3 is no longer produced, so that the driver 25 is deactivated and the solenoid 26 is deenergized, closing the valve 38 of the toner replenishment apparatus 13 and stopping replenishment of the toner to the developer supply, whereby the toner concentration of the developer 3 is maintained at the desired concentration.

As mentioned previously, the detection voltage signal S2 includes the D.C. components and A.C. components in an overlapping manner, and the A.C. components are generated by the flow of the developer 3 along the inner surface 34 of the viewing window 12 in the chute member 11, irrelevant to the variation in toner concentration of the developer 3. Therefore, when the flow of the developer 3 in the chute member 11 is stopped or the developer 3 clings to the inner surface 34 of the viewing window 12, the A.C. components are not produced at all. In other words, the presence of a certain level A.C. component in the detection voltage signal S2 indicates that the developer 3 is flowing properly through the chute member 11.

Therefore, by detecting the presence of the A.C. components in the detection voltage signal S2, abnormalities of the toner concentration detection apparatus, such as stopping of the flow of the developer 3 through the chute member 11 or clinging of the developer 3 to the inner surface 34 of the viewing window 12, can be readily detected. In order to perform such abnormality detection, the detection voltage signal S2 is also input to a high-pass filter 27, so that only the A.C. components are abstracted from the detection voltage signal S2, and an A.C. component signal S22 is output therefrom. The A.C. component signal S22 is then converted to a D.C. current by a rectifier smoothing circuit 28. The thus converted D.C. current is compared with a reference current which is generated by a reference current generator 30 by a comparator 29. The comparator 29 does not generate any signal when the developer 3 is normally flowing through the chute member 11. However, if the A.C. components are not produced in the detection current signal S2, for instance, due to stopping of the flow of the developer 3 in the chute member 11 or clinging of the developer 3 to the inner surface 34 of the viewing window 12, and some difference is thus detected between the D.C. current and the reference current, the comparator 29 immediately produces a warning signal and the operation of the copying apparatus is immediately stopped.

Thus, there is provided in accordance with the present invention a toner concentration control apparatus which has the advantages discussed above. The embodiment described is intended to be merely exemplary and those skilled in the art will be able to make variations and modifications in it without departing from the spirit and scope of the invention. In the present invention, the detection of the concentration of toner in the developer is not limited to the photoelectrical method. For instance, by detecting the variations in dielectric constant, magnetic flux density or resistivity of the developer during the flow thereof, the concentration of toner in the developer can be controlled, and from the A.C. components generated while detecting the dielectric constant, magnetic flux density or resistivity of the developer, the abnormalities of the toner concentration control apparatus can be detected.

All such modifications and variations are contemplated as falling within the scope of the claims.

What is claimed is:

1. A toner concentration control apparatus for controlling the concentration of toner in a dry type developer comprising at least toner and carrier for use in an electrophotographic copying apparatus comprising:

toner concentration detection means for outputting a current signal consisting of A.C. component signals and D.C. component signals, which A.C. component signals and D.C. component signals are in accordance, respectively, with the flow of said developer through a light-transmitting toner concentration detector portion of said toner concentration detection means, and the toner concentration of said developer, by illuminating said developer as it flows through said detector portion and converting light reflected by said developer to current signals;

A.C. and D.C. component signal separation means for separating said A.C. component signals from said D.C. component signals in said current signal;

developer-flow-abnormality detection means for indicating that the flow speed of said developer is out of a predetermined range, by comparing the level of said separated A.C. component signal with said developer flow reference signal; and toner replenishment means for replenishing toner to said developer or stopping replenishment thereof in accordance with the level of said D.C. component signals as compared with a predetermined D.C. component level.

2. A toner concentration control apparatus as claimed in claim 1, wherein said toner concentration detection means comprises:

developer circulation means which comprises said detector portion and which circulates said developer therethrough for detecting the concentration of toner in said dry type developer which passes through said toner concentration detector portion;

illumination means for said illuminating of said developer in said detector portion of said developer circulation means; and photosensing means for sensing at least light reflected by said developer as it passes through said detector portion, producing said current signal consisting of D.C. component signals which correspond to the concentration of toner in said developer and A.C. component signals which are generated by the flow of said detector portion.

3. A toner concentration control apparatus as claimed in claim 2, wherein said developer circulation means comprises a chute member capable of causing the passage of said developer therethrough, including a viewing window of transparent material disposed within said detector portion thereof, said developer being illuminated through said viewing window by said illumination means, and said viewing window allowing light reflected from said developer to pass back therethrough.

4. A toner concentration control apparatus as claimed in claim 2, wherein said photosensing means comprises a first photosensing element capable of sensing a reference light from said illumination means and producing a first signal corresponding to the intensity of said reference light, said first signal being said predetermined D.C. component signal, and a second photosensing element capable of sensing light reflected from said developer as it passes through said detector portion and is illuminated by said illumination means and producing a second signal corresponding to the intensity of said reflected light, said second signal being said current signal consisting of said D.C. component signals and said A.C. component signals.

5. A toner concentration control apparatus as claimed in claim 1, wherein said A.C. and D.C. component signal separation means comprises a low-pass filter for eliminating said A.C. component signal from said output of said toner concentration detection means and allowing said D.C. component signal to pass therethrough, and a high-pass filter for eliminating said D.C. component signal from said output of said toner concentration detection means and allowing said A.C. component signal to pass therethrough.

6. A toner concentration control apparatus as claimed in claim 1, wherein said developer-flow-abnormality detection means indicates stopping of the flow of said developer or a decrease in the flow thereof below a predetermined level through said toner concentration detection portion, by detecting the decrease or absence of said separated A.C. component signals, and deactivates said electrographic copying apparatus upon detecting the decrease below a predetermined level, or absence of said separated A.C. component signals.

7. A toner concentration control apparatus as claimed in claim 6, wherein said developer-flow-abnormality detection means comprises a comparator for comparing said separated A.C. component signal with said developer flow reference signal and producing an developer-flow-abnormality indication signal when the difference in value between said separated A.C. component signal and said developer flow reference signal exceeds a predetermined level, and deactivating said electrophotographic copying apparatus in accordance with said developer-flow-abnormality indication signal.

8. A toner concentration control apparatus as claimed in claim 1, wherein said toner replenishment means comprises a toner replenisher drive means comprising a comparator for comparing said separated D.C. component signal with a toner replenishment reference signal and capable of producing a toner replenishing command signal when the difference in value between said D.C. component signal and said toner replenishment reference signal exceeds a predetermined level, and a drive means for actuating said toner replenishment means in accordance with said toner replenishing command signal.

9. A toner concentration control apparatus for controlling the concentration of toner in developer comprising toner and carrier particles of different reflectivities for use in an electrophotographic copying apparatus comprising:

chute means capable of causing the passage of said developer therethrough;

a viewing window made of transparent material disposed within a portion of the body of said chute means;

a light source for illuminating said developer through said window;

first photosensing means capable of sensing a reference light from said light source and producing a D.C. signal corresponding to the intensity of said reference light;

second photosensing means capable of sensing light reflected from said developer as it passes over said viewing window in said chute means and is illuminated by said light source and producing a second signal corresponding to the intensity of said reflected light which second signal consists of a D.C. and an A.C. signal component;

low-pass filter means for eliminating the A.C. component signal from said second signal produced by said second photosensing means and allowing the D.C. component signal thereof to pass therethrough and producing a D.C. signal therefrom;

high-pass filter means for eliminating the D.C. component signal from said second signal produced by said second photosensing means and allowing the A.C. component thereof to pass therethrough and producing an A.C. signal;

first comparator means for comparing said first signal produced by said first photosensing means with said D.C. signal output from said low-pass filter means and producing a toner replenishing command signal when the difference in value between said first signal and said D.C. signal exceeds a predetermined level;

second comparator means for comparing said A.C. signal output from said high-pass filter means with a developer-flow-abnormality indication reference signal by which reference signal the predetermined optimum flow rate of said developer through said chute means if indicated, and producing a developer-flow-abnormality indication signal when the difference in value between said A.C. signal and said abnormality indication reference signal exceeds a predetermined level;

toner replenishing means capable of replenishing toner to the developer supply;

drive means for activating or deactivating said toner replenishing means in accordance with said toner replenishing command signal; and stop means for stopping the operation of said electrophotographic copying apparatus in accordance with said developer-flow-abnormality indication signal produced by said second comparator.

* * * * *